US006196595B1

(12) United States Patent
Sonerud

(10) Patent No.: US 6,196,595 B1
(45) Date of Patent: Mar. 6, 2001

(54) COUPLING DEVICE FOR CONNECTING AN IMPLEMENT TO A WORKING MACHINE

(75) Inventor: Åke Sonerud, Hudiksvall (SE)

(73) Assignee: Soneruds Maskin AB, Hudiksvall (SE)

( * ) Notice: Subject to any disclaimer, the term of this patent is extended or adjusted under 35 U.S.C. 154(b) by 0 days.

(21) Appl. No.: 09/125,462

(22) PCT Filed: Feb. 17, 1997

(86) PCT No.: PCT/SE97/00258

§ 371 Date: Apr. 15, 1999

§ 102(e) Date: Apr. 15, 1999

(87) PCT Pub. No.: WO97/30231

PCT Pub. Date: Aug. 21, 1997

(30) Foreign Application Priority Data

Feb. 19, 1996 (SE) ..... 9600608

(51) Int. Cl.[7] ..... F16L 35/00
(52) U.S. Cl. ..... 285/26; 285/920; 37/468
(58) Field of Search ..... 285/25, 26, 28, 285/29, 920; 37/468; 91/432; 414/723; 172/273, 275

(56) References Cited

U.S. PATENT DOCUMENTS

| | | | | |
|---|---|---|---|---|
| 3,527,480 | * | 9/1970 | Larson | 285/26 |
| 3,705,656 | | 12/1972 | Hunger et al. . | |
| 3,750,703 | | 8/1973 | Arita . | |
| 5,316,347 | * | 5/1994 | Arosio | 285/26 |
| 5,333,400 | * | 8/1994 | Sonerud | 37/468 |
| 5,465,513 | * | 11/1995 | Sonerud | 37/468 |
| 5,581,917 | * | 12/1996 | Barden | 37/468 |

FOREIGN PATENT DOCUMENTS

| | | | | |
|---|---|---|---|---|
| 390715 | * | 10/1990 | (EP) | 285/26 |
| 443 437 | | 2/1986 | (SE) . | |
| 463 319 | | 11/1990 | (SE) . | |
| 467 742 | | 9/1992 | (SE) . | |

* cited by examiner

*Primary Examiner*—Dave W. Arola
(74) *Attorney, Agent, or Firm*—Dykema Gossett PLLC

(57) ABSTRACT

A coupling arrangement for coupling a working implement to a working machine and being of the kind in which the two coupling parts are mutually connected both mechanically and hydraulically with no manual handling of the coupling arrangement. The machine-mounted coupling part has a drive means for moving associated hydraulic coupling connection means into coupling engagement with hydraulic coupling means on the implement-mounted coupling part, when coupling the machine and implement. The hydraulic coupling connection on the implement-mounted coupling part is movable in the direction of maneuvering movement of the hydraulic coupling, and is moved by the drive means via the hydraulic coupling connection on the machine-mounted coupling part until coming into abutment with an abutment means on the machine-mounted coupling part. The arrangement includes springs that function to exert a pressure that is opposed to this movement. The arrangement ensures that the clearance required for this mechanical coupling will not prevent effective and positive connection of the hydraulic couplings.

12 Claims, 3 Drawing Sheets

COUPLING DEVICE FOR CONNECTING AN IMPLEMENT TO A WORKING MACHINE

BACKGROUND OF THE INVENTION

The present invention relates to a coupling device for coupling a working implement to a working machine and having at least two coupling parts mutually connected both mechanically and hydraulically with no manual handling of the coupling arrangement. An implement of this kind, e.g. a so-called combi-bucket, is normally coupled to a working machine with the aid of a coupling arrangement that is designed to enable coupling of the implement to be achieved from the operating cabin of the working machine, so that the operator need not leave the cabin to couple the implement manually. The implement is normally maneuvered with the aid of pressure fluid, normally an hydraulic fluid. Thus, it is not only the implement that shall be coupled mechanically, but also the hydraulic lines. Quick coupling devices with which implements can be connected both mechanically and hydraulically without manual assistance are known to the art; cf., for instance, SE-443 437, SE-467 742 and SE-463 319.

When mechanically coupling the implement to the machine, the respective implement-mounted and machine-mounted coupling devices engage one within the other. A relatively large clearance of about 20 mm is required, to facilitate coupling of the implement. Such a large clearance cannot be accepted when quick-coupling the hydraulic couplings automatically, and consequently the clearance must be eliminated or at least limited in some way or the other. One possibility in this regard is to weld guide shoulders on one of the coupling parts. This solution, however, makes quick-coupling of the implement difficult to achieve, since the operator must position the coupling parts very precisely.

SUMMARY OF THE INVENTION

Against this background, it is an object of the present invention to provide a coupling arrangement that will enable the coupling parts for the operating fluid to be mutually coupled effectively and reliably without placing high demands on the mechanical precision at which the coupling parts are presented to one another.

This has been achieved in accordance with the invention with a coupling arrangement herein described.

Because the fluid coupling devices on the implement-mounted coupling part are resilient in the coupling direction, said devices, when no load acts on the spring, may be orientated in a position in which there is no risk of the mechanical machine-mounted coupling parts striking against the implement-mounted fluid coupling parts when mechanically coupling said coupling parts, even when there exists a clearance in the order of 20 mm. In conjunction with coupling the hydraulics, the implement-mounted fluid coupling device is moved to its correct position against the action of the spring by said maneuvering movement, wherein the implement-mounted fluid coupling is pressed in said position into abutment with a surface on the machine-mounted coupling part. This ensures a rapid, positive and correct coupling, both mechanically and hydraulically, without requiring the operator to leave the driving cabin of the machine.

Resilient or sprung hydraulic coupling arrangements are known in the art. For instance, U.S. Pat. No. 3,750,703 discloses an hydraulic coupling in which one part is resiliently mounted. This part is resilient only in a direction perpendicular to the coupling direction, for the purpose of compensating for the case when the coupling elements are not in register with one another. WO 90/10544 teaches an hydraulic coupling arrangement in which one coupling part is resilient in the coupling direction. The sole purpose of this arrangement is to provide a smooth coupling action. No direct movement of the resiliently mounted coupling element from a first to a second distinct position is achieved with this arrangement.

A simple and effective embodiment is obtained when resiliency is achieved with a mechanical spring, preferably a compression spring.

An optimal distance of resilient or spring movement is in the order of 20–50 mm, preferably 30–40 mm.

In one preferred embodiment of the invention, the invention is applied to a coupling arrangement with which the hydraulic coupling connections of the machine-mounted coupling part are disposed directly opposite and move outwards towards inwardly facing connections on the implement-carried part when effecting said coupling.

In another preferred embodiment, the hydraulic coupling connections of one or both parts are movable along guide bars.

The above preferred embodiments and other preferred embodiments of the invention will be evident from the following dependent claims.

BRIEF DESCRIPTION OF DRAWINGS

The invention will now be described in more detail with reference to a preferred embodiment thereof and also with reference o the accompanying drawings, in which.

DETAILED DESCRIPTION OF THE INVENTION

Figure 1:
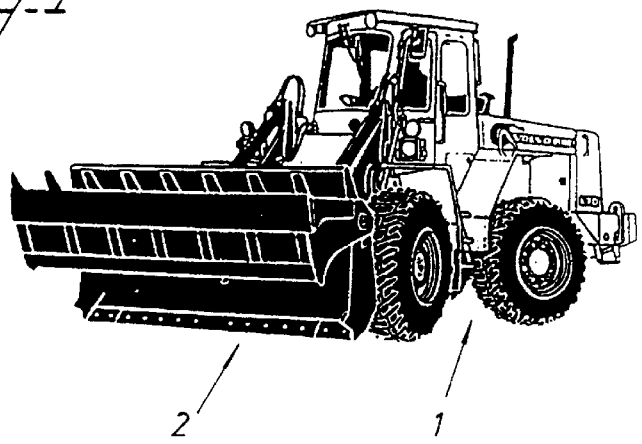
FIG. 1 is a stylized side view of a working machine with which the invention is applied.

The working machine 1 shown in FIG. 1 has coupled thereto an implement in the form of a hydraulic combibucket 2. The bucket is maneuvered hydraulically from the driving cabin of the machine. Coupling and uncoupling of the implement 2 is also effected from the driver's cabin. The remaining Figures. illustrate how the implement 2 is coupled to the arm of the machine 1.

Figure 2:
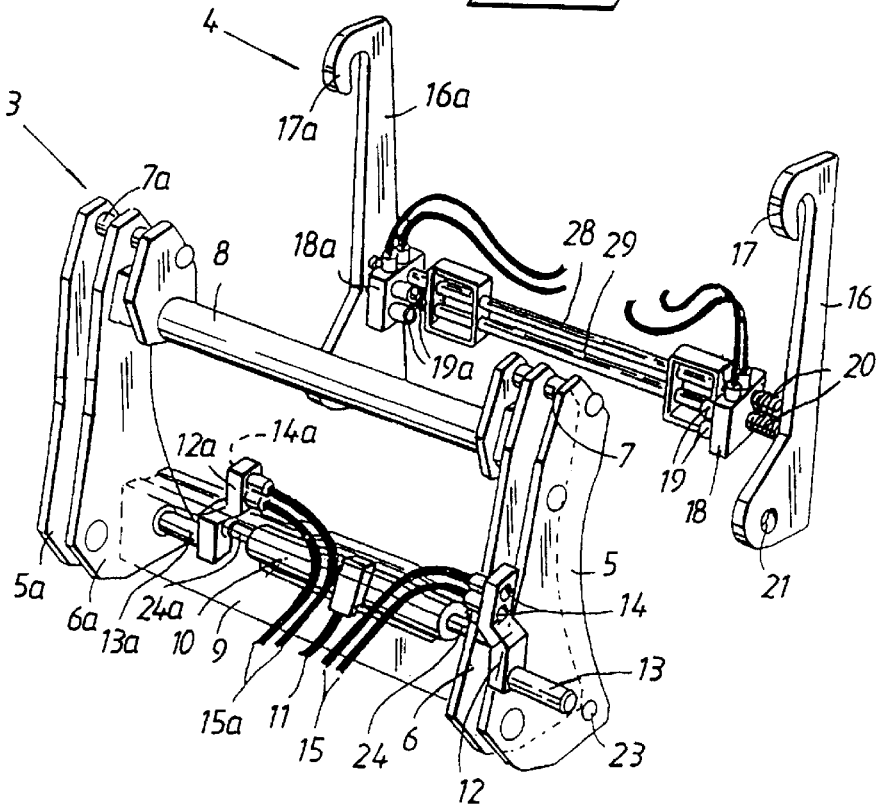
FIG. 2 is a perspective view of parts of the machine-mounted and implement-mounted coupling parts, with said parts in an uncoupled state.

With the intention of providing an understanding of the invention, FIG. 2 shows the vital parts of the machine-mounted coupling part 3 and the implement-carried coupling part 4. The machine-mounted coupling part 3 includes two side members each having an outer plate 5, 5*a* and an inner plate 6, 6*a* with a space between each of said plates, wherein an engagement pin 7, 7*a* is disposed in said space at the upper end thereof. The two side members are interconnected by an upper strut 8 and a connecting element 9 mounted at the bottom of said side members. Mounted in the connecting element 9 is a double-acting hydraulic cylinder 10 which is operated from the driving cabin of the machine through hydraulic lines 11. The hydraulic cylinder 10 is connected to a coupling arm 12, 12*a* in each direction through the medium of respective piston rods 24, 24*a*. (It will be noted that, for the sake of illustration, the coupling arm 12 shown to the right in the Figure is shown laterally displaced from its actual position. The coupling arm would actually be hidden by the inner plate 6). A locking plunger 13, 13*a* and hydraulic coupling elements 14, 14*a* are mounted on respective coupling arms 12, 12*a*, and the coupling arm is controlled by a guide way. These components will be explained in more detail further on. Hydraulic lines 15, 15*a* extend to the hydraulic coupling elements 14, 14*a*.

The implement-mounted coupling part 4 has provided on each side thereof an gripping arm 16, 16*a*, each of which has a hook 17, 17*a* at its top end. Extending between the two gripping arms 16, 16*a* is a pair of guide rails 28, 29 on which a coupling block 18, 18*a* located adjacent each gripping arm 16, 16*a* can move and on which the hydraulic coupling elements 19, 19*a*are mounted. Compression springs 20, 20*a* are disposed between each coupling block 18, 18*a* and respective gripping arms 16, 16*a* (of which springs those on the left side of the Figure are hidden from view.)

Figure 3:
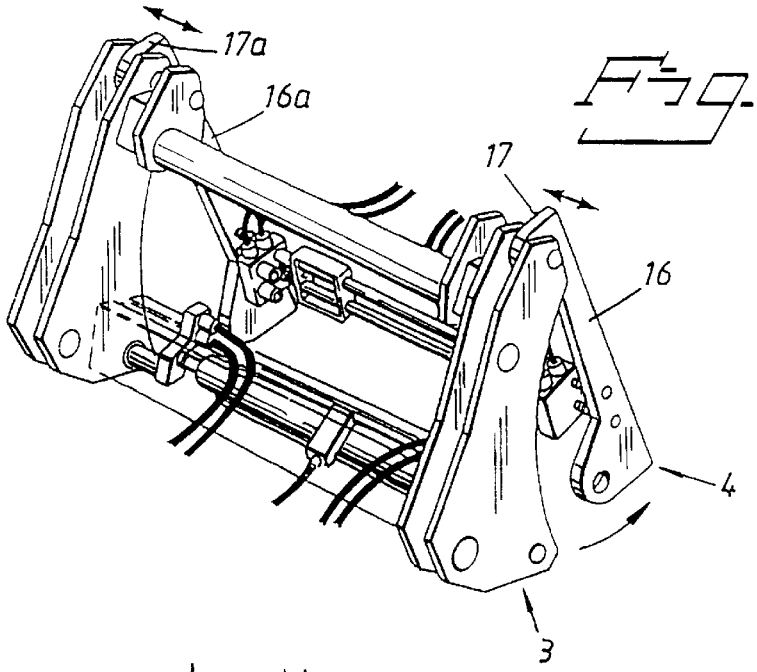
FIG. 3 is a view corresponding to the view of FIG. 2 but showing a stage in which mechanical coupling of said parts has begun.

FIG. 3 illustrates how the hooks 17, 17*a* of the respective gripping arms 16, 16*a* of the implement-mounted part are hooked around respective engagement pin 7, 7*a* on the side members of the machine-mounted part when coupling said parts together. The machine-mounted coupling part 3 is then swung from the illustrated position in towards the implement-mounted coupling part in the direction of the arrows, to a coupled position in which the implement is ready to be locked and the hydraulics connected. In order for hooking of the parts illustrated in FIG. 3 to be possible from the driving cabin in practice, it is necessary for the space between each plate pair on the machine-mounted coupling part to be slightly larger than the thickness of the hooks 17, 17*a*. It is therefore necessary to tolerate a clearance of about 10–20 mm.

Figure 4:
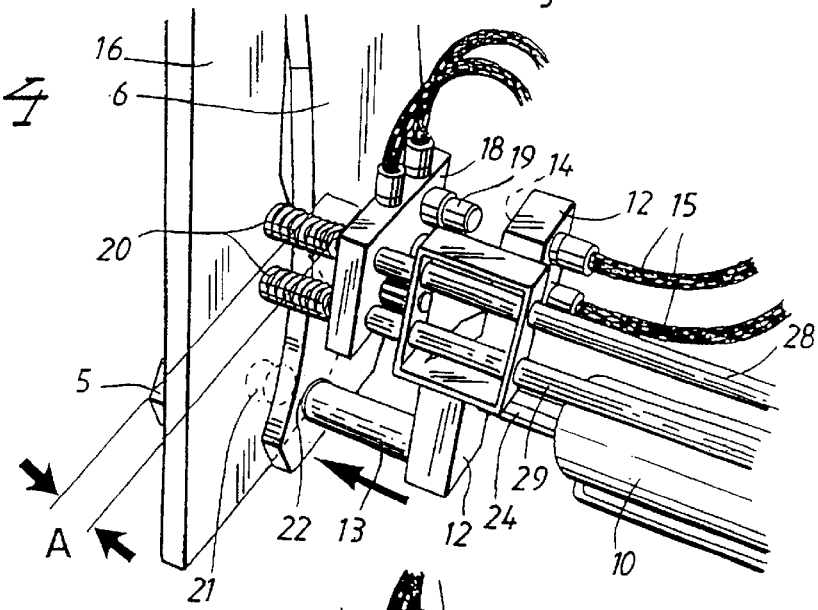
FIG. 4 is a perspective view of the devices shown in FIGS. 2 and 3 as seen in the opposite direction, wherein the coupling devices are in mutually coupled non-locked state but not hydraulically coupled.

FIG. 4 is a detailed view of part of the two coupling parts subsequent to the parts having been swung from the position shown in FIG. 3 to a position in which they are firmly locked and the hydraulics connected. This view shows the components from the other direction, i.e. rearwardly from FIG. 2 and FIG. 3.

The gripping arm 16 is shown in a position in which its lower part projects in between the outer and inner side plates 5 and 6 on the machine-mounted coupling part. In this position, a hole 21 in the gripping arm 16 is located opposite holes 22 and 23 provided in the inner and outer side plates respectively. The locking plunger 13 extends into the hole 22 in the inner side plate 6. The guides 28, 29 on the implement-mounted coupling part are situated so as not to contact the inner plate 6. The pressure springs 20 keep the coupling block 18, which is movably mounted on the guides and carries the hydraulic coupling elements 19, at a sufficiently large distance from the gripping arm 16 to ensure that the inner side plate will not strike against the coupling block 18 during the coupling movement illustrated in FIG. 3, and leave a safe distance thereto.

The coupling arm 12 carries the hydraulic coupling elements 14 (hidden in this Figure by the coupling arm) connected to the hydraulic lines 15, and the locking plunger 13 is movable along guide ways (hidden in FIG. 4) and is maneuvered with the aid of the piston rod 24 projecting from the hydraulic cylinder and connected to the coupling arm 12.

When coupling together the aforesaid coupling parts, the hydraulic cylinder 10 is activated so as to press the piston rod 24 outwards and move the coupling arm 12 in the arrowed direction. The locking plunger 13 will therewith be pressed through the hole 21 in the gripping arm 16 and the hole (hidden in this Figure) in the outer plate 5, so as to lock the implement-mounted coupling part mechanically through the machine-mounted coupling part. At the same time, the hydraulic coupling elements 14 will move towards corresponding hydraulic coupling elements 19 on the coupling block 18 and be brought into engagement with one another. The hydraulic coupling elements are of the male and female kind, wherein the female elements are disposed on the machine-mounted coupling part in the illustrated embodiment. When the hydraulic couplings are mutually connected, continued movement of the piston rod 24 will cause the coupling arm 12 to push the coupling block 18 forwards while overcoming the counterpressure force exerted by the compression springs 20. The inner side plate 6 forms an abutment surface for the coupling block 18, such as to terminate the coupling movement, wherewith the hydraulic connections are locked. This position is illustrated in FIG. 5, in which abutment between the coupling block 18 and the inner side plate 6 is marked symbolically with the distance A diminished to zero.

Figure 5:
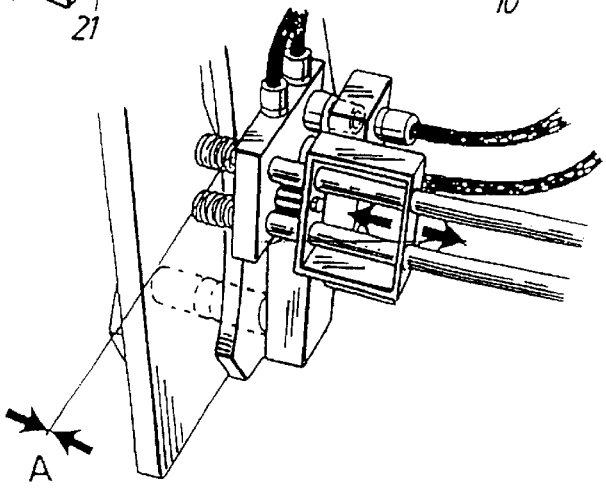
FIG. 5 is a view corresponding to FIG. 4 in which the coupling devices have been locked and hydraulically coupled.
Figure 6:
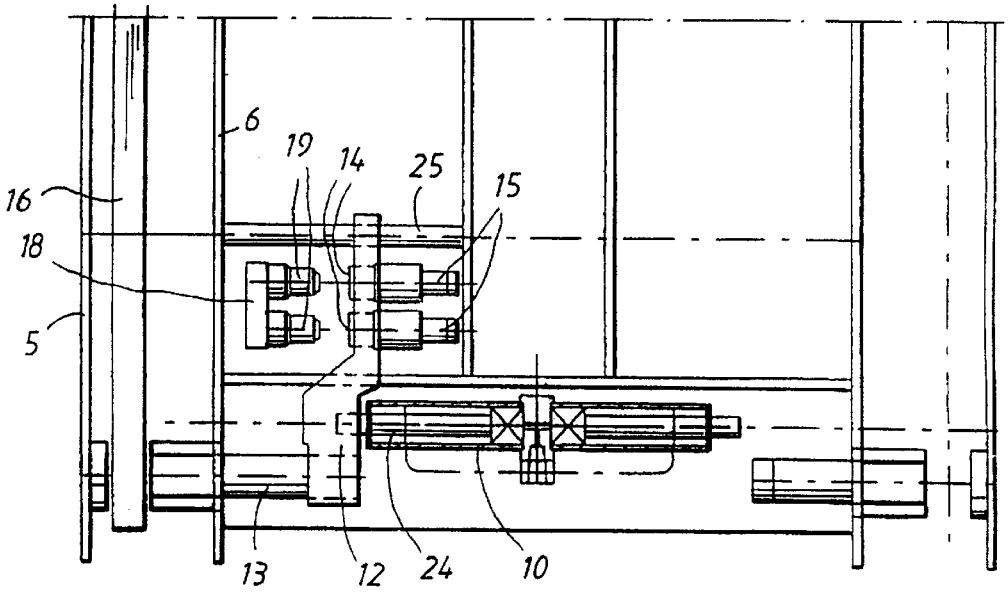
FIG. 6 is a schematic side view of the coupling devices in the position shown in FIG. 4.
Figure 7:
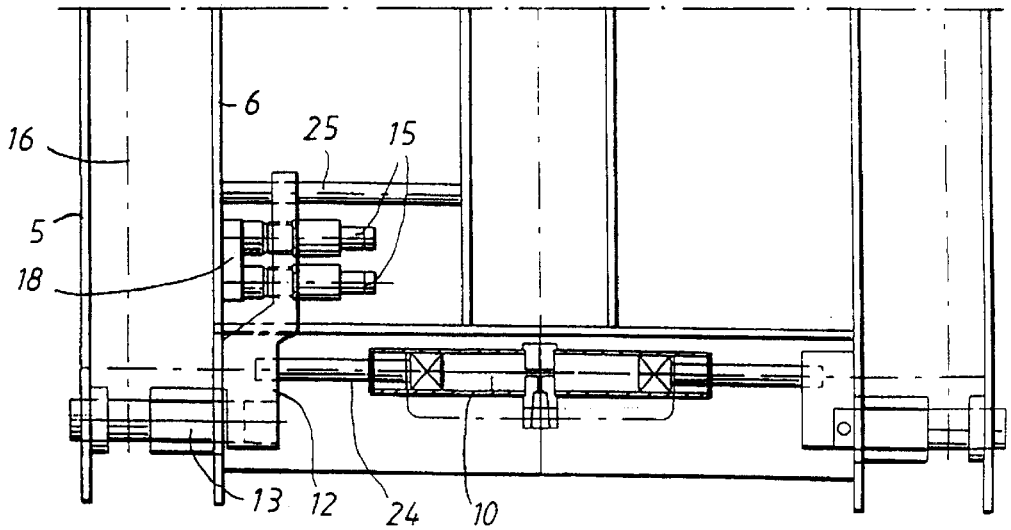
FIG. 7 is a view corresponding to the view of FIG. 6 but with the coupling devices in the position shown in FIG. 5.

The positions shown in FIGS. 4 and 5 are illustrated more schematically in FIGS. 6 and 7, with the intention of illustrating the function of the described arrangement more clearly. Thus, FIG. 6 shows how the piston rod 24 is retracted in the hydraulic cylinder 10, prior to having coupled the connection, and therewith holds the coupling arm 12 in a rearwardly retracted position in which the locking plunger 13 extends in through the hole in the inner side plate and the hydraulic coupling elements 14 are located opposite corresponding hydraulic coupling elements 19 on the implement-mounted coupling part, although not in contact therewith.

In FIG. 7 the cylinder 10 has been placed under pressure and the piston rod 24 is therefore extended to the left in the Figure, wherein the coupling arm 12 has been dogged by the piston rod and has moved the locking plunger 13 through the hole in the gripping arm 16 and through the hole in the outer side plate 5 such as to firmly lock said gripping arms, and has also moved the hydraulic coupling elements 14 into coupling engagement with the hydraulic coupling elements 19 and has moved said hydraulic coupling elements until the movement is stopped by abutment of the coupling block 18 with the inner side plate 6.

FIGS. 6 and 7 also show the guide 25 on which the coupling arm 12 is guided and which are hidden in the other figures.

What is claimed is:

1. A coupling arrangement comprising:

a first coupling part (3) connected to a working machine (1), the first coupling part having first fluid coupling means (12, 14; 12*a*, 14*a*) and abutment means (6, 6*a*);

a second coupling part (4) connected to a working implement and having second fluid coupling means (18, 19; 18*a*, 19*a*);

the first coupling part (3) has drive means (10, 14, 14*a*) for maneuvering the first fluid coupling means (12, 14; 12*a*, 14*a*) into connection with said second fluid coupling means (18, 19; 18*a*, 19*a*)

the second fluid coupling means (18, 19; 18*a*, 19*a*) are movable in the maneuvering direction;

a connection means (7, 17; 7*a*, 17*a*) for connecting the first coupling means with the second coupling means;

the drive means (10, 24, 24*a*) having a stroke length sufficient to move the first fluid coupling means (12, 14; 12*a*, 14*a*) into contact with the second fluid coupling means (18, 19; 18*a*, 19*a*) and the stroke length is sufficient to move said second fluid coupling means (18, 19; 18*a*, 19*a*) into abutment with the abutment means (6, 6*a*); and at least one spring means (20, 20*a*) which functions to act on said second fluid coupling means (18, 19; 18*a*, 19*a*) with a spring force that is opposed to said maneuvering movement.

2. A coupling arrangement according to claim 1, wherein each of said fluid coupling means (12, 14; 12*a*, 14*a*; 18, 19; 18*a*, 19*a*) includes a plurality of fluid coupling elements (14, 14*a*, 19, 19*a*) each of which is connected to a fluid line.

3. A coupling arrangement according to claim 1, wherein the spring means (20; 20*a*) is a mechanical compression spring device.

4. A coupling arrangement according to claim 1, wherein the first fluid coupling means (12, 14; 12*a*, 14*a*) includes at least one coupling arm (12; 12*a*) on which first fluid coupling elements (14; 14*a*) are disposed and with which said drive means (10, 24; 24*a*) is connected.

5. A coupling arrangement according to claim 4, wherein the coupling arm (12; 12*a*) includes locking means (13; 13*a*) for locking said first coupling part (3) to said second coupling part (4).

6. A coupling arrangement according to claim 1, wherein said second fluid coupling means (18, 19; 18*a*, 19*a*) include at least one coupling block (18; 18*a*) on which second fluid coupling elements (19; 19*a*) are disposed and to which said spring means (20; 20*a*) is connected.

7. A coupling arrangement according to claim 1, wherein said second fluid coupling means (18, 19; 18*a*, 19*a*) are movable through a distance of 20–50 mm before being stopped by said abutment means (6; 6*a*).

8. A coupling arrangement according to claim 7, wherein said distance is 30–40 mm.

9. A coupling arrangement according to claim 1, wherein said first and said second coupling parts (3, 4) include first frame means (5, 6; 5*a*, 6*a*) and second frame means (16, 16*a*) which are spaced a short distance apart when coupling said coupling parts, seen in the direction of maneuvering movement; and wherein said second fluid coupling means (18, 19; 18*a*, 19*a*) are arranged to be kept spaced from said first frame means (6; 6*a*) by a distance that is greater than said short distance, calculated in the direction of maneuvering movement.

10. A coupling arrangement according to any one of claims 1–9, wherein said drive means (10, 24, 24*a*) includes a fluid operated piston (24; 24*a*).

11. A coupling arrangement according to claim 1, wherein at least either the first fluid coupling means (12, 14; 12*a*, 14*a*) or the second fluid coupling means (18, 19; 18*a*, 19*a*) is guided on guides (25; 28, 29).

12. A coupling arrangement according to claim 1, wherein all of said coupling means are duplicated and arranged in mirror-image in relation to a symmetry plane passing through the coupling parts (3, 4), and wherein said maneuvering movement is an outward movement in each direction from said symmetry plane.

* * * * *